US005718533A

United States Patent [19]

Mullet et al.

[11] Patent Number: 5,718,533

[45] Date of Patent: Feb. 17, 1998

[54] SUPPORT BRACKET AND TRACK ASSEMBLY FOR SECTIONAL OVERHEAD DOORS

[75] Inventors: Willis Mullet, Pensacola Beach, Fla.; Thomas Brenton Bennett, III, Wooster; Roger Lee Dague, Millersburg, both of Ohio

[73] Assignee: Wayne-Dalton Corp., Mt. Hope, Ohio

[21] Appl. No.: 692,754

[22] Filed: Aug. 6, 1996

Related U.S. Application Data

[63] Continuation of Ser. No. 427,143, Apr. 24, 1995, Pat. No. 5,568,672, which is a continuation-in-part of Ser. No. 56,991, May 3, 1993, Pat. No. 5,408,724.

[51] Int. Cl.[6] ..... A47C 17/86

[52] U.S. Cl. ..... 403/393; 403/353; 403/348

[58] Field of Search ..... 403/393, 353, 403/348, 349; 5/201, 202

[56] References Cited

U.S. PATENT DOCUMENTS

| | | | |
|---|---|---|---|
| 1,055,522 | 3/1913 | Cumming | 403/353 X |
| 1,131,399 | 3/1915 | McGinley | 403/349 X |
| 1,247,938 | 11/1917 | Curtenius | 403/375 X |
| 2,534,641 | 12/1950 | Veigel | 16/94 R |
| 2,643,581 | 6/1953 | Wehrenfenning | 403/349 X |
| 2,686,926 | 8/1954 | Schacht, Jr. et al. | 16/94 R |
| 2,991,496 | 7/1961 | Wolf et al. | 16/94 R |
| 3,009,719 | 11/1961 | Otto et al. | 403/348 X |
| 3,071,400 | 1/1963 | Bellock | 403/353 X |
| 3,129,751 | 4/1964 | Weber | 16/94 R |
| 3,156,282 | 11/1964 | Bedford, Jr. | 403/375 X |
| 3,659,884 | 5/1972 | Ohlin | 403/348 X |
| 3,761,970 | 10/1973 | Fredman | 5/201 X |
| 3,986,318 | 10/1976 | McConnell | 403/353 X |
| 4,133,560 | 1/1979 | Ishikawa et al. | 403/349 X |
| 4,382,710 | 5/1983 | Slowbe | 403/348 X |
| 4,538,936 | 9/1985 | Zeidl | 403/348 X |
| 4,653,708 | 3/1987 | Rich | 403/348 X |
| 4,662,024 | 5/1987 | Moench | 403/348 X |
| 5,489,162 | 2/1996 | LoCicero et al. | 403/353 X |

FOREIGN PATENT DOCUMENTS

| | | | |
|---|---|---|---|
| 8809303 | 6/1989 | Germany . | |
| 713906 | 9/1966 | Italy . | |
| 161615 | 4/1921 | United Kingdom | 403/353 |

*Primary Examiner*—Anthony Knight

*Attorney, Agent, or Firm*—Renner, Kenner, Greive, Bobak, Taylor & Weber

[57] ABSTRACT

A support bracket and track assembly for the support of sectional overhead doors. The assembly comprises a track (110, 112, 114) for supporting the overhead door sections and a horizontal support bracket (80) for supporting the track (110, 112, 114). The assembly further comprises a flag bracket (140) for mounting the track (110, 112, 114) and the support bracket (80) to a structural support, and a tab (90, 120, 130) for attaching the track (110, 112, 114) to the support bracket (80) and the flag bracket (140). A related fastening system for use with overhead sectional door components comprises first (80, 140) and second (112, 114) components, a tab (90) extending from the first component (80, 140) for engaging the second component (112, 114), and a tab slot (120, 130) in the second component for receiving the tab (90) of the first component (80, 140).

12 Claims, 9 Drawing Sheets

SUPPORT BRACKET AND TRACK ASSEMBLY FOR SECTIONAL OVERHEAD DOORS

RELATED APPLICATION

This application is a continuation of application Ser. No. 08/427,143 filed Apr. 24, 1995, now U.S. Pat. No. 5,568, 672, which is a continuation-in-part of U.S. Ser. No. 08/056, 991 filed May 3, 1993, now U.S. Pat. No. 5,408,724.

TECHNICAL FIELD

The present invention is directed toward jamb brackets, support brackets, and track assemblies for sectional overhead doors and the like. Each jamb bracket and/or support bracket engages the track member and is in turn attached to the door jamb or other structural support. The brackets hold the track in a fixed position relative to the door so that the door may roll freely in the track. Such assemblies are typically used in conjunction with overhead sectional garage doors in both residential and commercial settings.

BACKGROUND ART

Typically, jamb brackets are manufactured in a single piece from heavy angle iron or from stamped angles and flat stock, which must be fastened together with screws or rivets. Heavy material thicknesses are required with such brackets to provide the necessary strength. Attachment of the track to the jamb bracket has previously been accomplished by flat or round head bolts and nuts. Such bolts must be adjusted precisely in order to ensure adequate clearance for the door rollers in the track.

Generally horizontal angle brackets are provided for overhead door systems to add stiffness and strength to the track system so that the track will not deflect under the load of the door when the door is stored in its open position. Typically such brackets are bolted to the track member by means of mechanical fasteners such as screws if the components are to be assembled in the field, or spot welded if the components are pre-assembled. In instances where it is desired to assemble track components in the field, it is desired to use versatile components adapted for use in various arrangements. Known attempts at imparting a degree of versatility in such component parts include providing plural holes and/or slots in the components, in the interfacing area to allow some preassembly and adjustment prior to final securing of the components. The hole and/or slot arrangement, while flexible, lacks stability during assembly.

Despite the years that jamb brackets, support brackets, and track assemblies have been employed and the various design variations, assembly and installation time as well as manufacturing costs can be significant. Installation and assembly involving numerous elements and fasteners is tedious and requires multiple adjustments to ensure smooth operation of the door.

DISCLOSURE OF THE INVENTION

It is therefore an object of the present invention to provide a bracket whereby a track member can be mounted to a door jamb or other structural support.

It is another object of the present invention to provide a jamb bracket and track member which can be manufactured from thin gauge material, yet still provide adequate strength.

It is yet another object of the present invention to provide jamb brackets, support brackets, and track members which can be easily connected and adjusted without the need for tools or separate fasteners.

It is still another object of the present invention to provide jamb brackets, support brackets, and track members which can be inexpensively manufactured using commonly available materials and conventional manufacturing techniques.

At least one or more of the foregoing objects, together with the advantages thereof over known brackets and track assemblies, which shall become apparent from the specification which follows, are accomplished by the invention as hereinafter described and claimed.

In general, a support bracket and track assembly for the support of sectional overhead doors comprises track means for supporting the overhead door sections, horizontal support bracket means for supporting the track means, flag bracket means for mounting the track means and horizontal support bracket means to a structural support, and tab means for attaching the track means to the horizontal support bracket means and the flag bracket means.

The present invention also provides a related fastening system for joining components of overhead sectional doors comprising first and second components to be joined, tab means extending from the first component for engaging the second component, and tab slot means in the second component for receiving the tab means of the first component.

PREFERRED EMBODIMENT FOR CARRYING OUT THE INVENTION

Figure 1:
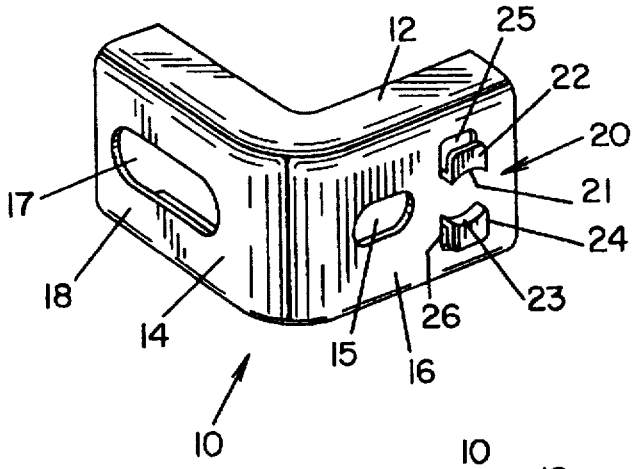
FIG. 1 is a perspective view of a jamb bracket according to the present invention.

A representative embodiment of a jamb bracket according to the concept of the present invention is generally referred to by the numeral 10 in the accompanying drawings. The jamb bracket 10 is manufactured from a thin gauge metal, preferably a galvanized steel in the range of 16 gauge to 20 gauge. The use of such thin gauge material is facilitated by the U-shaped cross section of jamb bracket 10. This U-shaped cross section is defined by an inturned flange 12 and a body 14. Flanges 12 are inturned 90 degrees relative to body 14 and are in the range of 6 to 20 material thicknesses high. Such a configuration provides strength and rigidity without the need for thicker, more heavy materials.

Figure 2:
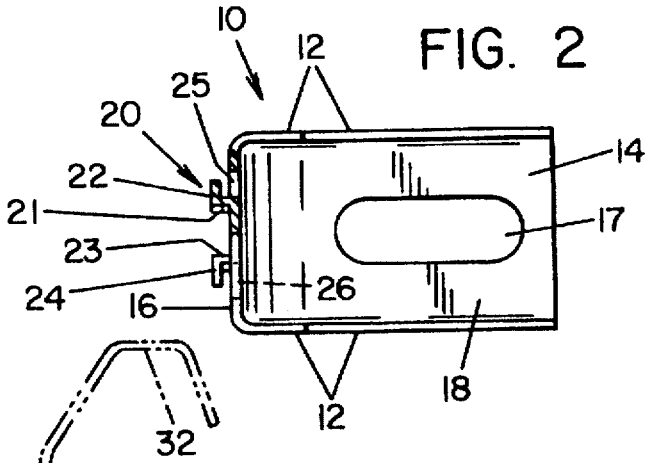
FIG. 2 is a rear view, partially in section, of the jamb bracket.
Figure 3:
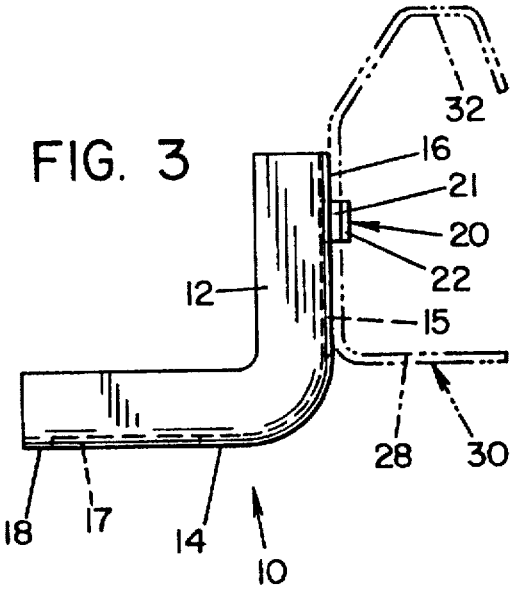
FIG. 3 is a top plan view of the jamb bracket, depicting a track member in phantom.
Figure 4:
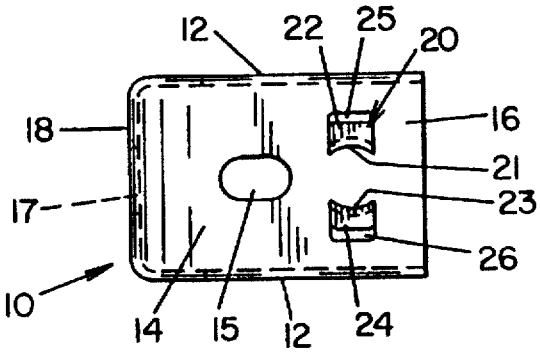
FIG. 4 is a side elevation of the jamb bracket.

With reference to FIGS. 1 and 2 it can be seen that jamb bracket 10 is bent at a right angle thereby defining a first leg 16 and a second leg 18. First leg 16 and second leg 18 are each provided with oblong apertures 15 and 17, respectively, for reasons which will become apparent as the description continues. First leg 16 is also provided with tab means, indicated generally by the numeral 20. Tab means 20 includes an arcuate first arm 21 and an ear 22. The arcuate first arm 21 extends perpendicularly from the body 14 and ear 22 extends perpendicularly therefrom and parallel to body 14. Tab means 20 also provides an arcuate second arm 23 and an ear 24. The arcuate second arm 23 extends perpendicularly from the body 14 and ear 24 extends perpendicularly therefrom and parallel to body 14. For reasons which will become apparent, ears 22 and 24 are offset from body 14 by a distance approximating the material thickness of the track member. Tab means 20 is positioned such that the arcuate first arms 21 and 23 face one another and form the partial circumference of a circle.

Tab means 20 is formed in a conventional manner, such as by stamping the arms 21 and 23 from first leg 16, leaving a pair of apertures 25, and then bending the ears 22 and 24 away from each other and perpendicular to arms 21 and 23, respectively.

Figure 5:
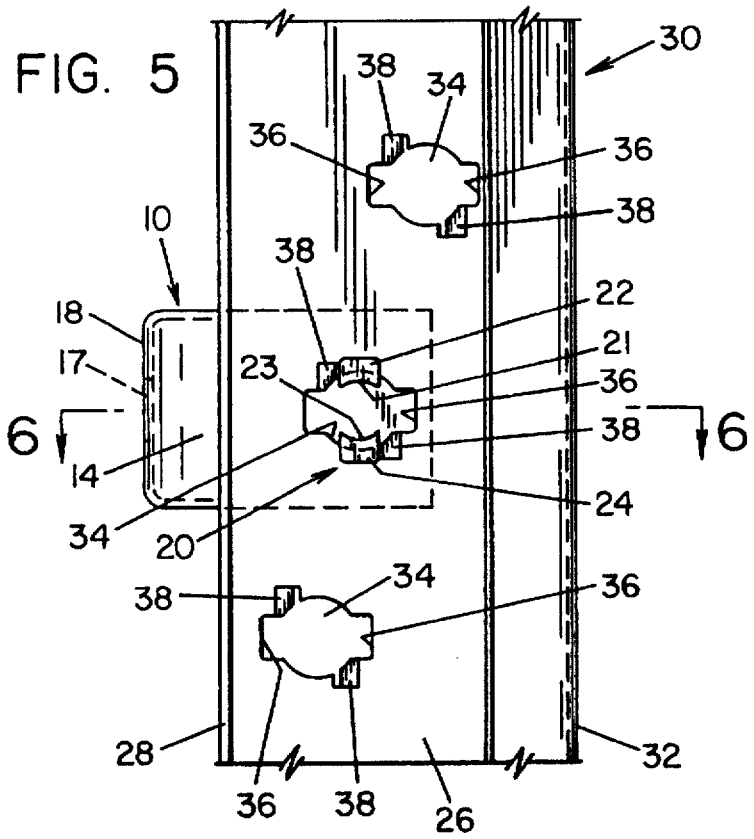
FIG. 5 is a side view of a track member according to the present invention with an attached jamb bracket.
Figure 6:
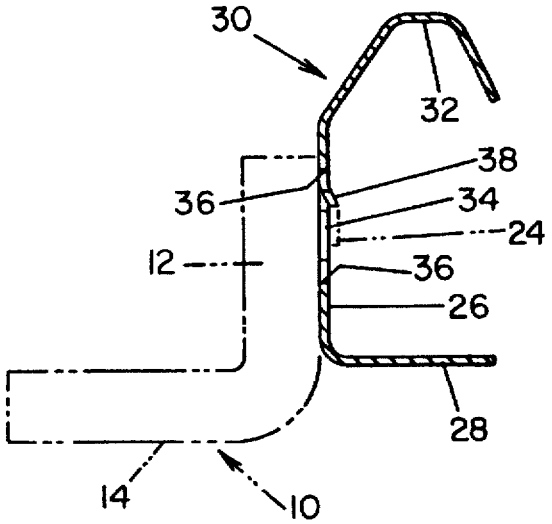
FIG. 6 is a sectional view of the track member, taken substantially on line 6—6 of FIG. 5.

With reference now to FIGS. 5 and 6, a representative embodiment of a track member according to the concept of the present invention is referred to generally by the numeral 30. Track member 30 is manufactured from any appropriate material, preferably a galvanized steel in the range of 16 gauge to 18 gauge in thickness, and is of a conventional C-shaped cross section to accommodate the conventional door rollers (not shown). The C-shaped cross section is defined by a main body 26, a flange 28 and a roller race 32. A number of tab slots 34 are included in groups, preferably of three or more at various locations along the length of the main body 26. Tab slots 34 are primarily circular in shape with the circumference being interrupted by a pair of rectangular notches 36. The notches 36 are diametrically opposed from one another and are perpendicular to the length of the track member 30. The circumference of tab slot 34 is further interrupted by a pair of flared stops 38. Flared stops 38 are formed by a stamping process whereby the material is flared inwardly at points opposite one another on the circumference of tab slot 34 and adjacent to respective rectangular notches 36.

Assembly of the present invention is accomplished first by fastening together the required track members 30. The number of track members 30 which are required for a particular installation is dictated primarily by the size of the door to be installed. Jamb bracket 10 may then be mounted to track member 30. Mounting is accomplished by first aligning ears 22 and 24 of tabs 20 on the jamb bracket 10 with the rectangular notches 36 of tab slots 34 on the track member 30. Once such alignment is accomplished, tabs 20 of jamb bracket 10 may be inserted into tab slots 34 of track member 30. Jamb bracket 10 is then rotated counterclockwise 90 degrees relative to track member 30 at which point tabs 20 will engage flared stops 38, thereby preventing further clockwise rotation. Simultaneously, the arcuate surfaces of first arms 21 and 23 of tab means 20 on the jamb bracket 10 frictionally engage the inner diameter of the tab slots 34 of the track member 30.

As discussed previously, ears 22 and 24 of tab means 20 are offset from the body 14 of jamb bracket 10 by a distance corresponding to the material thickness of track member 30, as such, first and second ears 22 and 24 frictionally engage the inner surface of track member 30. Thus, the jamb bracket 10 is held in locking engagement with track member 30 until sufficient torque is applied in a clockwise direction to overcome the frictional engagement, and tab means 20 clears tab slots 34.

Once jamb bracket 10 has been assembled to track member 30, the assembly may be mounted to the door jamb. Attachment of the jamb bracket 10 to the door jamb is accomplished by utilizing first oblong aperture 17 which receives a conventional fastener such as a lag screw. The lag screw is, in turn, fastened to the door jamb. First oblong aperture 17 allows for adjustment of the jamb bracket 10 and track member 30 relative to the door jamb. Further adjustment of the assembly may be accomplished by moving jamb bracket 10 from one tab slot 34 to another horizontally and vertically offset tab slot 34, the tab slots 34 being provided at numerous locations on track member 30. The second oblong aperture 15 is provided on the first leg 16 of jamb bracket 10 so that a track member may be attached to jamb bracket 10 by conventional means such as flat or round head bolts. The latter is desirable where the jamb bracket is to be used with a conventional track member. In such an instance, tabs 20 may be flattened or removed so as not to interfere with attachment of the jamb bracket 10 to the track member.

A representative embodiment of an alternative embodiment of jamb bracket according to the concept of the present invention is generally referred to by the numeral 40 in the accompanying drawings. The jamb bracket 40 is manufactured from a thin gauge metal, preferably a galvanized steel in the range of 16 gauge to 20 gauge. The use of such thin gauge material is facilitated by the U-shaped cross section of jamb bracket 40. This U-shaped cross section is defined by an inturned flange 42 and a body 44. Flanges 42 are inturned 90 degrees relative to body 44 and are in the range of 6 to 20 material thicknesses high. Such a configuration provides strength and rigidity without the need for thicker, more heavy materials.

Figure 7:
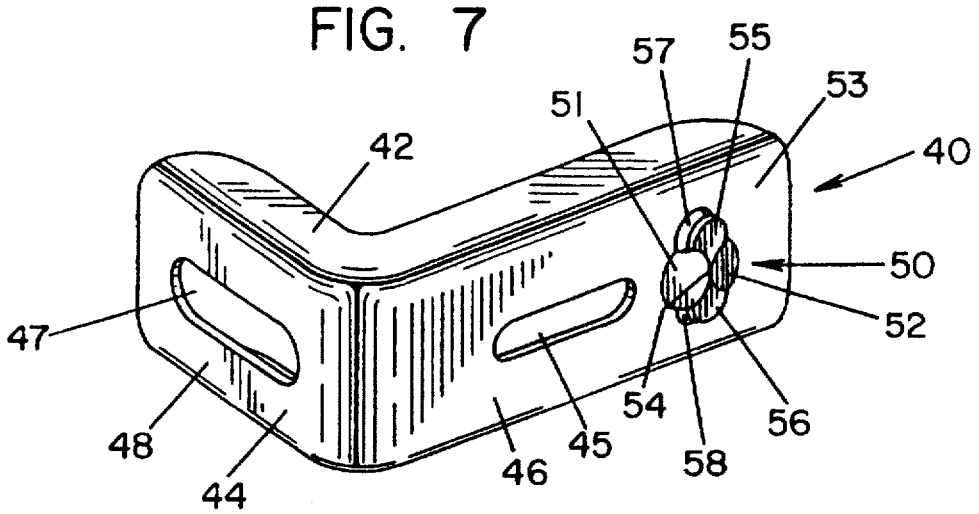
FIG. 7 is a perspective view of an alternate embodiment of jamb bracket according to the present invention.
Figure 8:
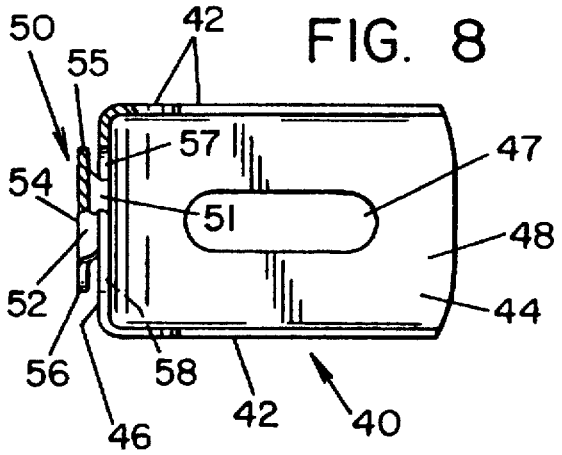
FIG. 8 is a rear view, partially in section, of the jamb bracket of FIG. 7.
Figure 9:
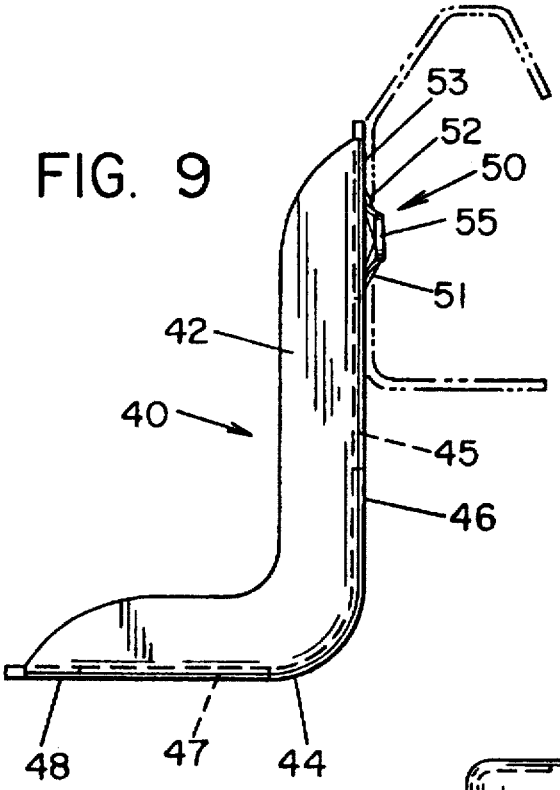
FIG. 9 is a top plan view of the jamb bracket of FIG. 7, depicting a track member in phantom.
Figure 10:
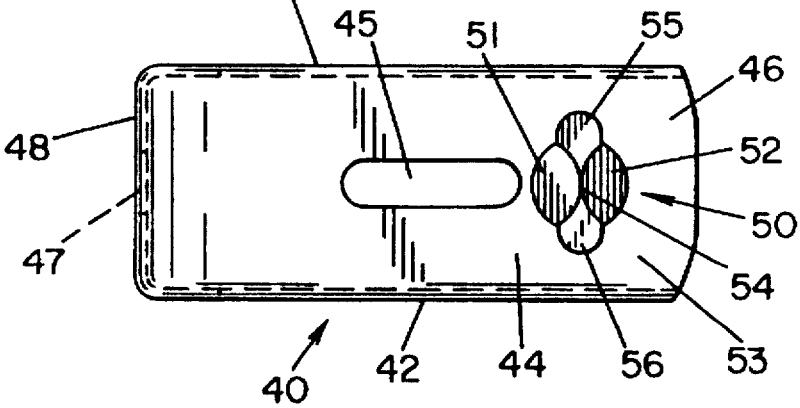
FIG. 10 is a side elevation of the jamb bracket of FIG. 7.

With reference to FIGS. 7 and 8 it can be seen that jamb bracket 40 is bent at a right angle thereby defining a first leg 46 and a second leg 48. First leg 46 and second leg 48 are each provided with oblong apertures 45 and 47, respectively. First leg 46 is also provided with tab means, indicated generally by the numeral 50. Tab means 50 includes a pair of arms 51 and 52 which are stamped outwardly from the face 53 of first leg 46 and are joined together in a saddle 54. Extending outwardly at generally 90 degree angles from arms 51 and 52 and saddle 54 are a pair of ears, 55 and 56, respectively. As is apparent from FIGS. 7 and 10, the ears 55 and 56 have a north and south orientation while the arms 51 and 52 are oriented to the west and east, respectively. Apertures 57 and 58 are formed in first leg 46 when the ears 55 and 56 are stamped. Although the ears 55 and 56 appear flat, it is to be understood that they could be further formed to bend downwardly or upwardly with respect to face 53 and, that they could also be curved along the north-south axis to provide a concave face toward face 53. For reasons which will again become apparent, ears 55 and 56 are offset from body 44 by a distance approximating the material thickness of the track member.

Figure 11:
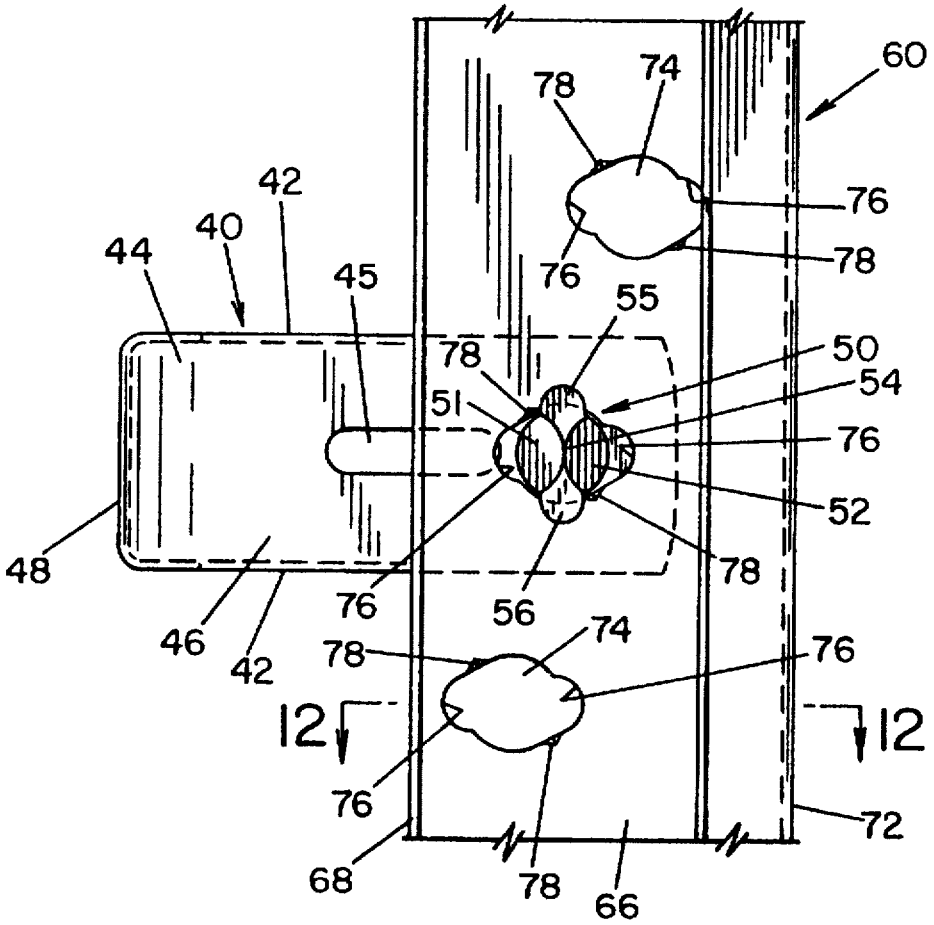
FIG. 11 is a side view of a track member according to the present invention with an attached jamb bracket of FIG. 7.
Figure 12:
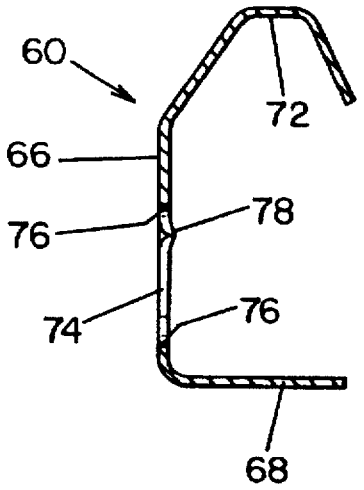
FIG. 12, is a sectional view of the track member, taken substantially on line 12—12 of FIG. 11.

With reference now to FIGS. 11 and 12, a representative embodiment of a track member according to the concept of the present invention is referred to generally by the numeral 60. Track member 60 is manufactured from any appropriate material, preferably a galvanized steel in the range of 16 gauge to 18 gauge in thickness, and is of a conventional C-shaped cross section to accommodate the conventional door rollers (not shown). The C-shaped cross section is defined by a main body 66, a flange 68 and a roller race 72. A number of tab slots 74 are included in the main body 66. Tab slots 74 are primarily circular in shape with the circumference being interrupted along the east-west axis by a pair of semi-circles 76. The semi-circles 76 are diametrically opposed from one another and are perpendicular to the length of the track member 60. The circumference of tab slot 74 is further interrupted by a pair of flared stops 78, which are formed at the intersection of tab slot circumference and the semi-circles 76 by a stamping process whereby the material is flared inwardly at points opposite one another on the circumference of tab slot 74.

Assembly of the present invention is accomplished first by fastening together the required track members 60. The number of track members 60 which are required for a particular installation is again dictated primarily by the size of the door to be installed. Jamb bracket 40 may then be mounted to track member 60. Mounting is accomplished by first aligning ears 55 and 56 of tabs means 50 on the jamb bracket 40 with the semi-circles 76 of tab slots 74 on the track member 60. Once such alignment is accomplished, the ears 55 and 56 are inserted into tab slots 74 of track member 60. Jamb bracket 40 is then rotated counter-clockwise 90 degrees relative to track member 60 at which point ears 55 and 56 will engage flared stops 78, thereby preventing further clockwise rotation. Simultaneously, the raised circumferential regions of arms 51 and 52 frictionally engage the inner diameter of the tab slots 74. As discussed previously, the ears 55 and 56 of tab means 50 on the jamb bracket 40 are offset from the body 44 of jamb bracket 40 by a distance corresponding to the material thickness of track member 60. Thus, the jamb bracket 40 is held in locking engagement with track member 60 until sufficient torque is applied in a clockwise direction to overcome the frictional engagement, and tab means 50 clear tab slots 74.

Once jamb bracket 40 has been assembled to track member 60, the assembly may be mounted to the door jamb. Attachment of the jamb bracket 40 to the door jamb is accomplished by utilizing oblong aperture 47 which receives a conventional fastener such as a lag screw. The lag screw is, in turn, fastened to the door jamb. The oblong aperture 47 allows for adjustment of the jamb bracket 40 and track member 60 relative to the door jamb. Further adjustment of the assembly may be accomplished by moving jamb bracket 40 from one tab slot 74 to another, the tab slots 74 being provided at several locations on track member 60. The second oblong aperture 45 is provided on the first leg 46 of jamb bracket 40 so that a track member may be attached to jamb bracket 40 by conventional means such as flat or round head bolts. The latter is desirable where the jamb bracket is to be used with a conventional track member. In such an instance, tab means 50 may be flattened or removed so as not to interfere with attachment of the jamb bracket 10 to the track member.

Referring now to FIGS. 13–18, a horizontal support bracket according to the concept of the present invention is referred to generally by the numeral 80. As shown, horizontal support bracket 80 resembles a conventional angle bracket, in that it is manufactured from a length of 10–18 gauge steel or other appropriate material, bent at a right angle along the entire length thereof to form two distinct legs, 82*a* and 82*b*. For purposes of discussion, support bracket 80 will be described with reference to a first end 84 and a second end 86. As can be seen, support bracket 80 is provided with a plurality (preferably three) of tab members 90 in each leg 82 proximate to first end 84 thereof. Tab members 90 are substantially the same as tab means 50 described above with respect to jamb bracket 40. Accordingly, each tab member 90 includes a pair of arms 92 and 94 which are stamped outwardly from face 96 of each leg 82 and are joined together in a saddle 98. Ears 100 and 102 extend outwardly at generally 90-degree angles from arms 92 and 94, respectively. Apertures 104 and 106 are formed in legs 82 when ears 100 and 102 are stamped. For reasons which will become apparent, ears 100 and 102 are offset from face 96 of legs 82 by a distance equal to or slightly greater than the material thickness of the horizontal track member yet to be described. It should be recognized that ears 100 and 102, while oriented generally parallel to face 96, may be flat, concave, or otherwise angled with respect to face 96. In fact, it is preferred, for reasons which will become apparent, to slightly angle ears 100 and 102.

One or more conventional fastener apertures 108 are provided in each leg 82 of bracket 80 proximate to second end 86. Apertures 108 may include a combination of oblong apertures, as well as square or round apertures. The number, shape, placement, and spacing of apertures 108 may vary according to the application, it being desired only to provide a maximum number for adaptability to mounting conditions. As is perhaps most apparent in FIG. 13, tab members 90 and fastener apertures 108 are located in each leg 82 directly opposite corresponding tab members 90 or fastener apertures 108 in the other leg 82. As such, each leg 82 is a mirror image of the other leg 82.

A track assembly adapted for use with the above described support bracket 80 is designated generally by the numeral 110. Track assembly 110 includes a horizontal track member 112 and a vertical track member 114. Track members 112 and 114 are both of a conventional C-shaped cross-section like that described with respect to track members 30 and 60 above.

Horizontal track member 112 includes a straight portion 116 and a curved portion 118. Straight portion 116 is characterized by a plurality of slotted tab apertures 120 located proximate to curved portion 118. Each slotted tab aperture 120 is defined by a north-south oriented oblong portion 122 which is intersected by an east-west oriented oblong portion 124 to form a generally T-shaped aperture. The number and location of tab apertures 120 corresponds to the number and location of tab members 90 on support bracket 80. That is, if support bracket 80 includes three tab members 90, track member 112 should include at least three tab apertures 120*a*, 120*b*, and 120*c*. Likewise, the spacing of tab apertures 120 should correspond to the spacing of tab members 90 such that the center spacing of tab members 90 is equal to the center spacing of north-south oriented oblong portions 122 of apertures 120. Similarly, the length of oblong portion 122 should correspond to the distance between the tips of ears 100 and 102 of tab members 90, while the width of oblong portions 124 corresponds to the width of arms 92 and 94 of tab members 90. At the end 126 of track member 112 proximate to curved portion 118, track member 112 is provided with an additional slotted tab aperture 120*d* (FIG. 16) and may further be provided with one or more conventional fastener apertures 128.

Vertical track member 114 is a generally straight conventional track section adapted to abut end 126 of horizontal track member 112. A tab aperture 130 similar to tab slots 24 described above with respect to track member 60 is provided in track member 114 at one end 132 thereof. Tab aperture 130 is generally circular in shape with the circumference thereof being interrupted along the east-west axis by a pair of diametrically opposed semi-circles 134.

Figure 18:
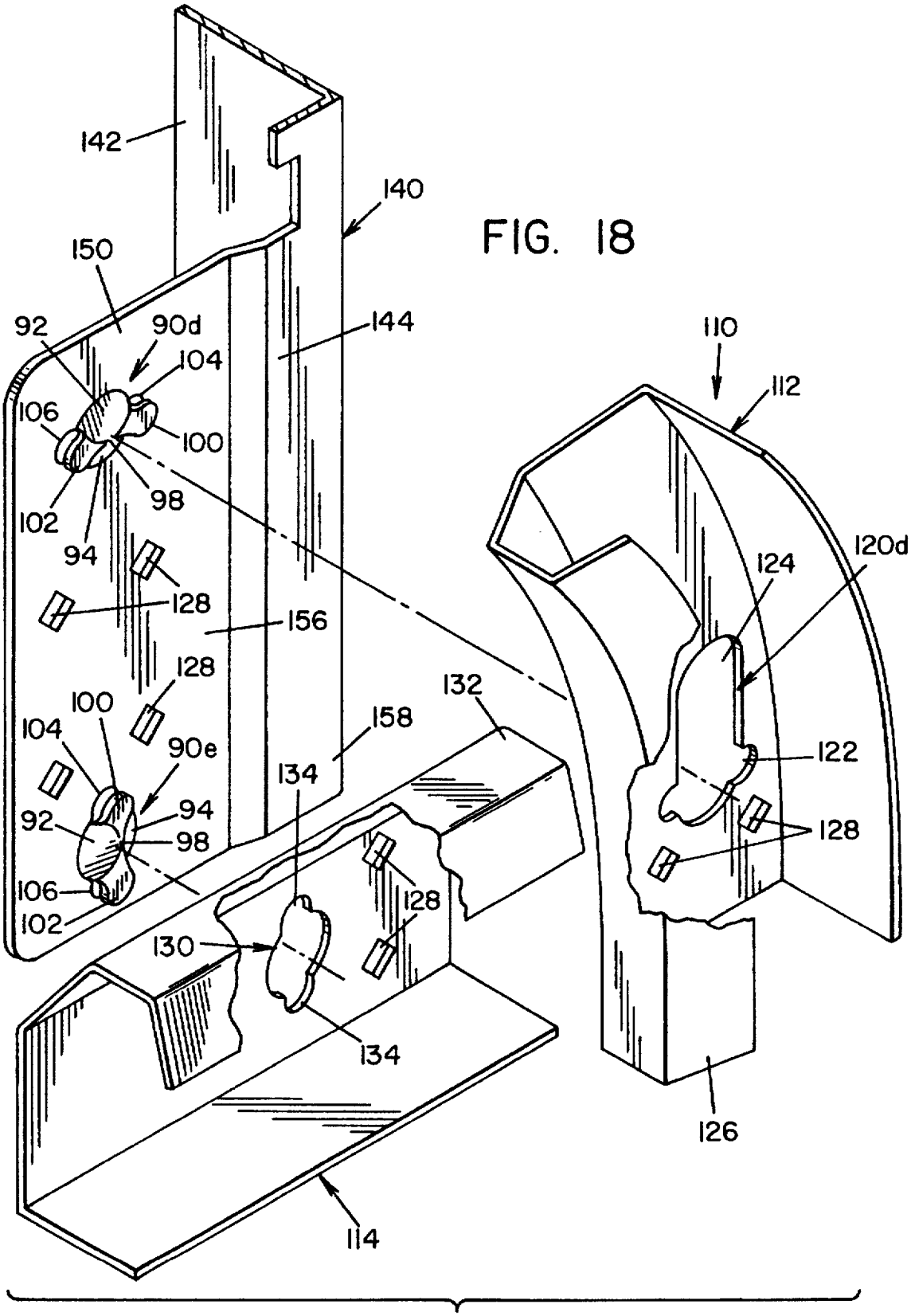

A flag bracket according to the concept of the invention is designated generally by the numeral 140. Flag bracket 140 is substantially similar to conventional flag brackets used for mounting a track assembly to a structural support. As such, flag bracket 140 is bent at a right angle along the length thereof to form a structural mounting flange 142 and a track supporting flange 144. Flange 142 is provided with a plurality of fastener apertures 146 which may be round, square, or of an oblong shape, as shown. Track supporting flange 144 is defined by a horizontal bracket mounting portion 148 and a track member mounting portion 150. Horizontal bracket mounting portion 141 includes one or more conventional fastener apertures 52, proximate to a first end 154 of flag bracket 140. Track member mounting portion 150 is characterized by a pair of tab members **90*d* and 90*e* which extend outwardly from face 156 thereof, proximate to a second end 158 of bracket 140. As is best shown in FIG. 18, tab member 90*d* has its ears 100 and 102 oriented east and west, respectively. Tab member 90*e* is spaced directly below tab member 90*d* but is rotated 90 degrees relative thereto so that its ears 100 and 102** are oriented north and south, respectively.

Figure 13:
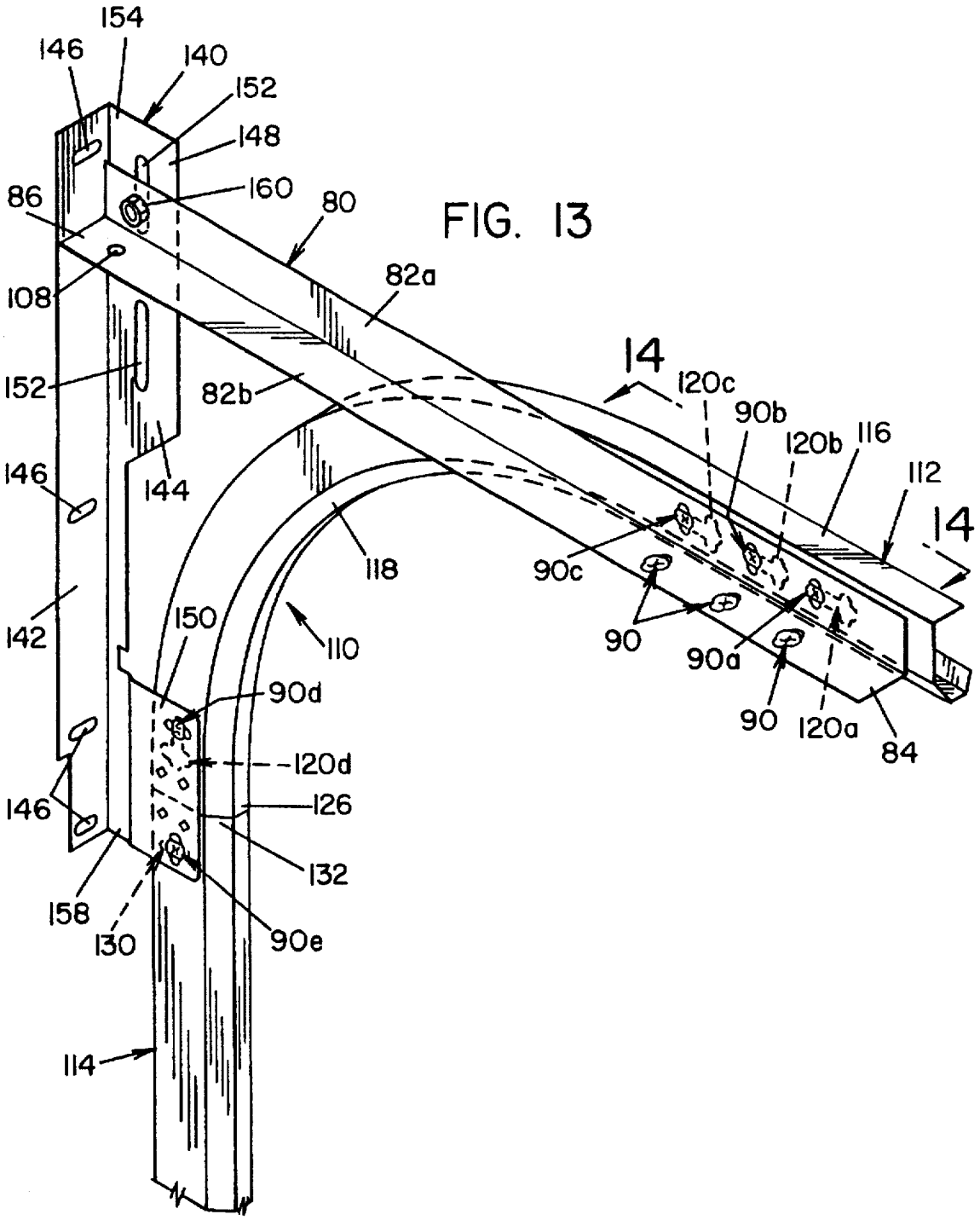
FIG. 13 is a perspective view of a support bracket and track assembly according to the invention.
Figure 15:
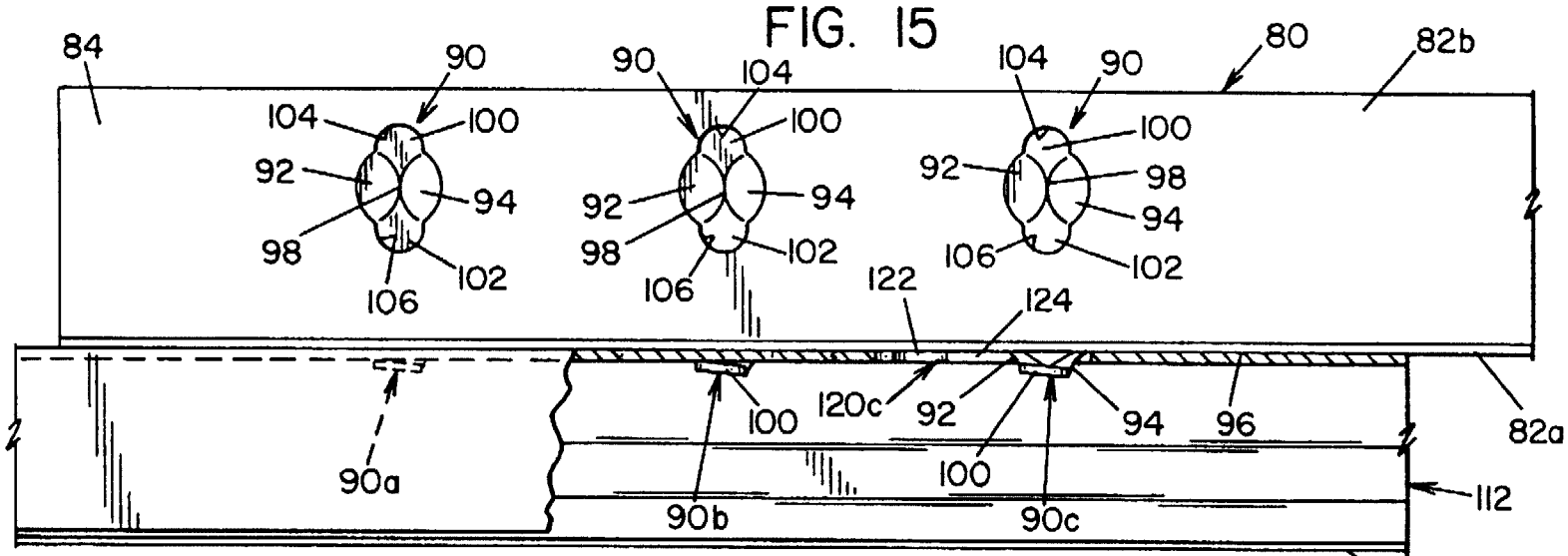
FIG. 15 is an elevational view of the assembly of FIG. 14 taken along line 15—15.
Figure 14:
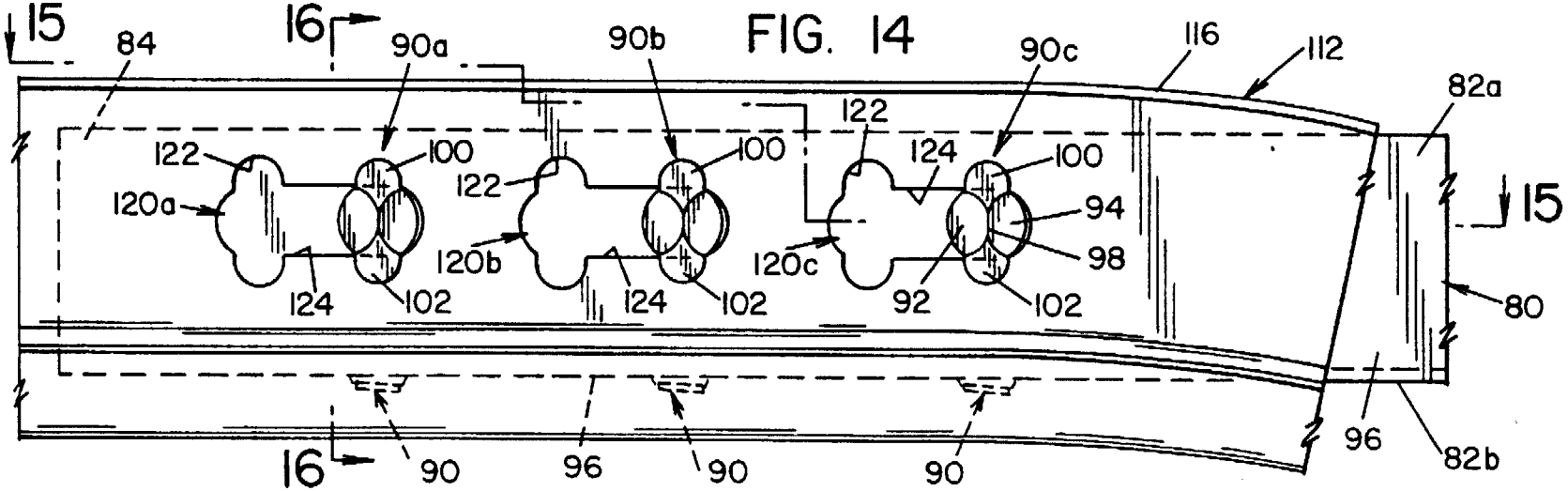
FIG. 14 is an elevational view o a section o the assembly of FIG. 13 taken along the line 14—14.
Figure 16:
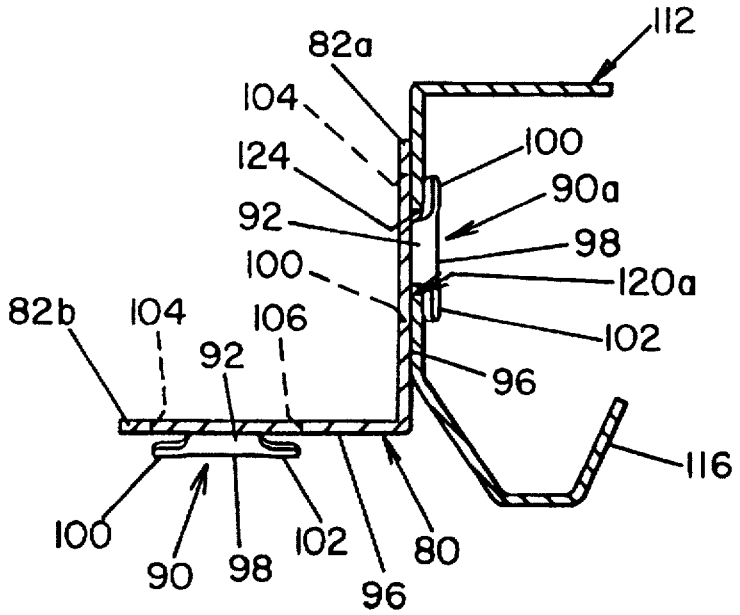
FIG. 16 is a cross-sectional view of the assembly of FIG. 14 taken along the line 16—16.
Figure 17:
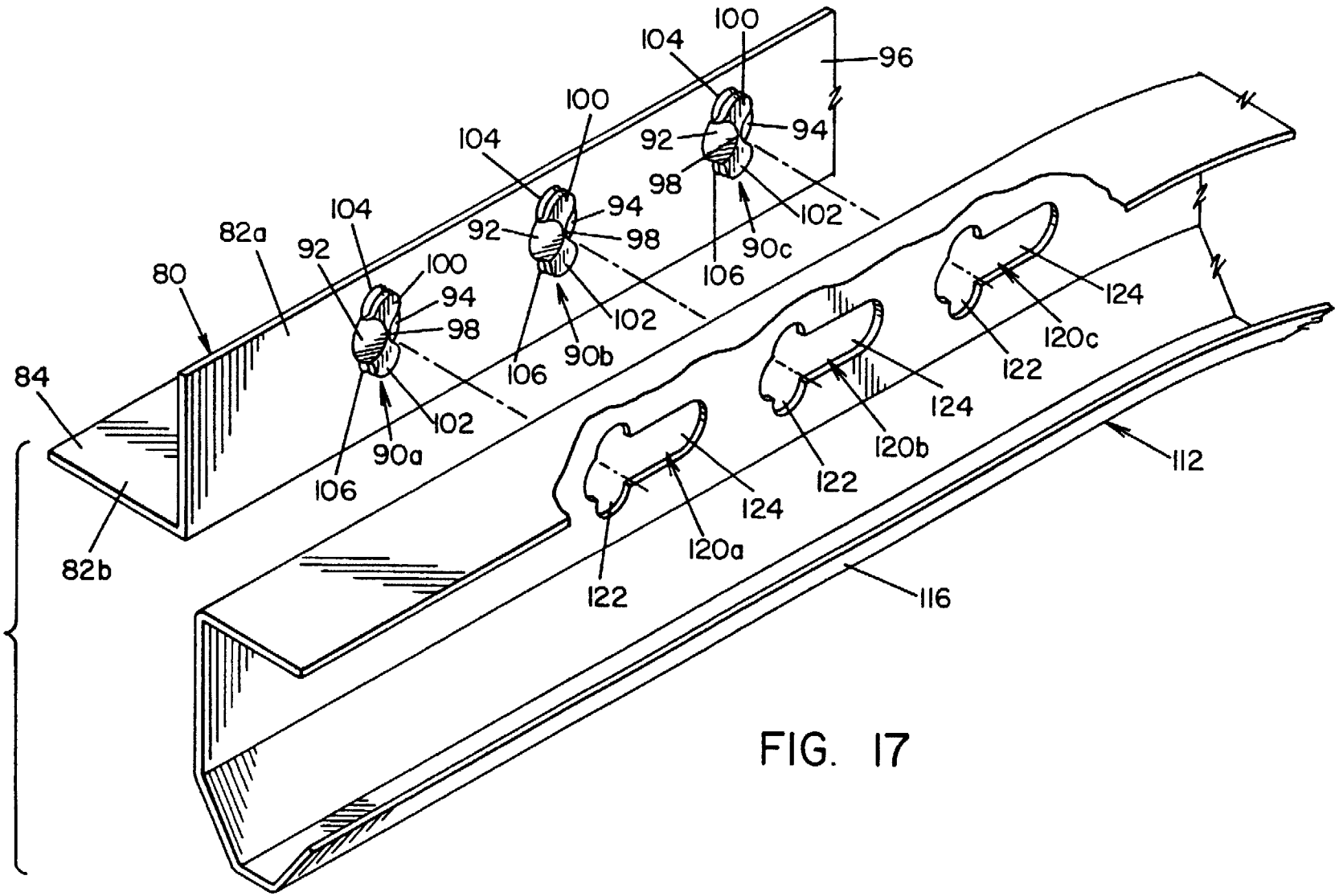
FIG. 17 is an exploded perspective view of the assembly of FIG. 14; and, FIG. 18 is an exploded perspective view depicting the assembly of the track members to the flag bracket.

Assembly of horizontal support bracket 80, track assembly 110, and flag bracket 140 is accomplished by first aligning tab member **90*e* with tab aperture 130 of vertical track member 114, as shown in FIG. 18. Accordingly, semi-circles 134 of tab aperture 130 are aligned to receive ears 100 and 102 of tab member 90*e*. Track member 114 may then be rotated counterclockwise 90 degrees to the position shown in FIG. 13. Slotted tab apertures 120*d* of track member 112 may then be aligned with tab member 90*d* of flag bracket 140, as shown in FIG. 18. As such, ears 100 and 102 of tab member 90*d* may be passed through the oblong portion 122 of aperture 120*d*. Track member 112 may then be slid downward relative to flag bracket 140 to seat against track member 114, as shown in FIG. 13. Tab members 90*a*, 90*b*, and 90*c* of horizontal support bracket 80 may be similarly aligned with slotted tab apertures 120*a*, 120*b*, and 120*c*, respectively, of track member 112, as shown in FIG. 17. Support bracket 80 may then be slid toward the flag bracket 140 so that tab members 90 are seated in apertures 120, as shown in FIGS. 14 and 15. Support bracket 80 may then be affixed to flag bracket 140 by way of a conventional fastener 160 which engages apertures 108 and 152 of support bracket 80 and flag bracket 140, respectively. The entire assembly may then be mounted to a structural support by affixing flag bracket 140** to the support using conventional fasteners.

It should now be apparent to those skilled in the art that the brackets and track assembly of the invention allow the component parts to be assembled quickly and sturdily in the field prior to final adjustment. It should further be recognized that tab members 90, tab apertures 130, and slotted tab apertures 120 may be provided at other locations and on other components. For example, a jamb bracket such as that described above could be adapted to engage a track member and hanger means to support the track member from overhead. Further, the provision of conventional fastener apertures 128, 146, and 152 allows the component parts to be utilized in a conventional manner.

Thus it should be clear, to those skilled in the art, the manner in which the jamb bracket and track assembly described herein is constructed, assembled and used. It should also be clear that the jamb brackets 10 and 40 are novel and may be utilized with the track member 30 and 60, respectively, of this invention as well as existing track members.

Based upon the foregoing disclosure, it should now be apparent that the use of the assembly described herein will carry out the objects set forth hereinabove. It should also be apparent to those skilled in the art that the jamb bracket and track assembly can be utilized in conjunction with various types of overhead sectional doors.

Although approximate thicknesses have been disclosed for the materials, none of the ranges should be interpreted as limiting. It is believed that those skilled in the art can determine the materials and sizes that will be most useable from the total specification disclosure provided herein.

It is, therefore, to be understood that any variations evident fall within the scope of the claimed invention and thus, the selection of specific component elements can be determined without departing from the spirit of the invention herein disclosed and described. Moreover, the scope of the invention shall include all modifications and variations that may fall within the scope of the attached claims.

What is claimed is:

1. A fastening system for joining bracket and track components for sectional overhead doors comprising:

first and second components to be joined;

tab means extending from said first component for engaging said second component;

said tab means extending upwardly from said first component;

tab slot means in said second component for receiving said tab means of said first component;

said tab slot means defining an inner slot surface, said tab slot means comprising a generally circular aperture interrupted about its circumference by a pair of opposed semi-circles;

said tab means frictionally engaging said second component and said inner slot surface to frictionally lock said first component to said second component, said tab means including first and second arms angularly extending from said first component, said first and second arms being joined along a common edge to form a saddle; and first and second ears extending perpendicularly from said first and second arms, respectively, said tab means being insertable in said generally circular aperture when said first and second ears are aligned with said opposed semi-circles of said aperture; and said first component is rotatable with respect to said second component.

2. A fastening system, as set forth in claim 1, wherein said tab slot means comprises a first oblong aperture and a second oblong aperture intersecting said first oblong aperture at a right angle to form a generally T-shaped slot.

3. A fastening system, as set forth in claim 2, wherein said tab means is insertable in said T-shaped slot when said first and second ears are aligned with said first oblong portion and said tab means is slidable within said second oblong aperture, whereby said first component is slidable with respect to said second component.

4. A fastening system for joining bracket and track components for sectional overhead doors comprising:

first and second components to be joined;

a tab extending from said first component;

said tab including a pair of arms;

an ear extending from each of said arms;

said second component having a tab slot, said tab slot having an inner slot surface;

said tab slot including a substantially circular aperture interrupted about its circumference by a pair of opposed rectangular notches;

said tab being insertable into said slot when said ears are aligned with said notches;

said first component being rotatable with respect to said second component such that said arms frictionally engage said inner slot surface and said ears frictionally engage said second component to frictionally lock said first component to said second component.

5. A fastening system, as set forth in claim 4, wherein said arms extend substantially perpendicularly from said first component.

6. A fastening system as set forth in claim 4, wherein said arms are arcuate and disposed to face each other and form part of a circle.

7. A fastening system, as set forth in claim 4, wherein said ears extend substantially perpendicularly from said arms.

8. A fastening system, as set forth in claim 4, further comprising a pair of stops disposed about the circumference of said slot, said ears engaging said stops when said first component is rotated with respect to said second component.

9. A fastening system for joining bracket and track components for sectional overhead doors comprising:

first and second components to be joined;

a tab extending from said first component;

said tab including first and second arms angularly extending from said first component, said first and second arms being joined along a common edge to form a saddle;

first and second ears extending perpendicularly from said first and second arms, respectively;

said second component having a tab slot;

said tab slot including a generally circular aperture interrupted about its circumference by a pair of opposed semi-circles;

said tab being insertable into said slot when said ears are aligned with said semi-circles;

said first component being rotatable with respect to said second component such that said tab frictionally engages said second component to frictionally lock said second component to said first component.

10. A fastening system, as set forth in claim 9, further comprising a pair of stops disposed about the circumference of said slot, said stops engaging said ears when said first member is rotated with respect to said second member.

11. A fastening system, as set forth in claim 9, wherein said arms frictionally engage said second component when said first component is rotated with respect to said second component.

12. A fastening system, as set forth in claim 9, wherein said ears frictionally engage said second component when said first component is rotated with respect to said second component.

* * * * *

UNITED STATES PATENT AND TRADEMARK OFFICE

CERTIFICATE OF CORRECTION

PATENT NO. : 5,718,533

DATED : February 17, 1998

INVENTOR(S) : Willis Mullet, et al

It is certified that error appears in the above-identified patent and that said Letters Patent is hereby corrected as shown below:

The title page, showing an illustrative figure, should be deleted and substitute therefore the attached title page.

Signed and Sealed this

Second Day of June, 1998

Bruce Lehman

*Attest:*

BRUCE LEHMAN

*Attesting Officer*

*Commissioner of Patents and Trademarks*

United States Patent [19]

Mullet et al.

[11] Patent Number: 5,718,533

[45] Date of Patent: Feb. 17, 1998

[54] SUPPORT BRACKET AND TRACK ASSEMBLY FOR SECTIONAL OVERHEAD DOORS

[75] Inventors: Willis Mullet, Pensacola Beach, Fla.; Thomas Brenton Bennett, III, Wooster; Roger Lee Dague, Millersburg, both of Ohio

[73] Assignee: Wayne-Dalton Corp., Mt. Hope, Ohio

[21] Appl. No.: 692,754

[22] Filed: Aug. 6, 1996

Related U.S. Application Data

[63] Continuation of Ser. No. 427,143, Apr. 24, 1995, Pat. No. 5,568,672, which is a continuation-in-part of Ser. No. 56,991, May 3, 1993, Pat. No. 5,408,724.

[51] Int. Cl.[6] ..... A47C 17/86

[52] U.S. Cl. ..... 403/393; 403/353; 403/348

[58] Field of Search ..... 403/393, 353, 403/348, 349; 5/201, 202

[56] References Cited

U.S. PATENT DOCUMENTS

| | | | |
|---|---|---|---|
| 1,055,522 | 3/1913 | Cumming | 403/353 X |
| 1,131,399 | 3/1915 | McGinley | 403/349 X |
| 1,247,938 | 11/1917 | Curtenius | 403/375 X |
| 2,534,641 | 12/1950 | Veigel | 16/94 R |
| 2,643,581 | 6/1953 | Wehrenfenning | 403/349 X |
| 2,686,926 | 8/1954 | Schacht, Jr. et al. | 16/94 R |
| 2,991,496 | 7/1961 | Wolf et al. | 16/94 R |
| 3,009,719 | 11/1961 | Otto et al. | 403/348 X |
| 3,071,400 | 1/1963 | Bellock | 403/353 X |
| 3,129,751 | 4/1964 | Weber | 16/94 R |
| 3,156,282 | 11/1964 | Bedford, Jr. | 403/375 X |
| 3,659,884 | 5/1972 | Ohlin | 403/348 X |
| 3,761,970 | 10/1973 | Fredman | 5/201 X |
| 3,986,318 | 10/1976 | McConnell | 403/353 X |
| 4,133,560 | 1/1979 | Ishikawa et al. | 403/349 X |
| 4,382,710 | 5/1983 | Slowbe | 403/348 X |
| 4,538,936 | 9/1985 | Zeidl | 403/348 X |
| 4,653,708 | 3/1987 | Rich | 403/348 X |
| 4,662,024 | 5/1987 | Moench | 403/348 X |
| 5,489,162 | 2/1996 | LoCicero et al. | 403/353 X |

FOREIGN PATENT DOCUMENTS

| | | | |
|---|---|---|---|
| 8809303 | 6/1989 | Germany . | |
| 713906 | 9/1966 | Italy . | |
| 161615 | 4/1921 | United Kingdom | 403/353 |

*Primary Examiner*—Anthony Knight

*Attorney, Agent, or Firm*—Renner, Kenner, Greive, Bobak, Taylor & Weber

[57] ABSTRACT

A support bracket and track assembly for the support of sectional overhead doors. The assembly comprises a track (110, 112, 114) for supporting the overhead door sections and a horizontal support bracket (80) for supporting the track (110, 112, 114). The assembly further comprises a flag bracket (140) for mounting the track (110, 112, 114) and the support bracket (80) to a structural support, and a tab (90, 120, 130) for attaching the track (110, 112, 114) to the support bracket (80) and the flag bracket (140). A related fastening system for use with overhead sectional door components comprises first (80, 140) and second (112, 114) components, a tab (90) extending from the first component (80, 140) for engaging the second component (112, 114), and a tab slot (120, 130) in the second component for receiving the tab (90) of the first component (80, 140).

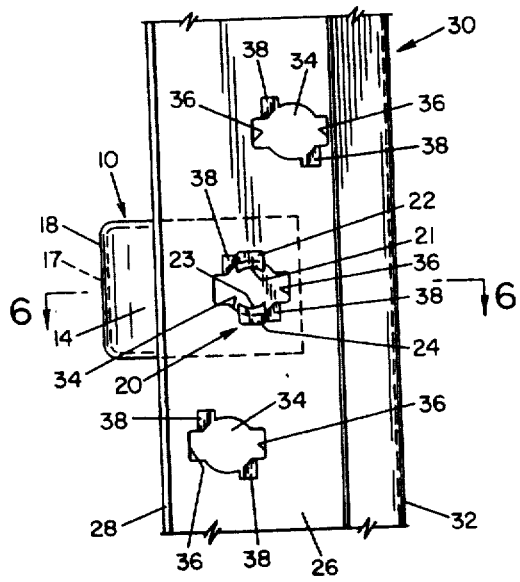

12 Claims, 9 Drawing Sheets